US006932744B1

(12) United States Patent
Ford et al.

(10) Patent No.: US 6,932,744 B1
(45) Date of Patent: Aug. 23, 2005

(54) POLE VAULT TRAINING DEVICE

(76) Inventors: Richard W. Ford, 74401 R.D. 437, Bertrand, NE (US) 68927; Martha E. Ford, 74401 R.D. 437, Bertrand, NE (US) 68927

( * ) Notice: Subject to any disclaimer, the term of this patent is extended or adjusted under 35 U.S.C. 154(b) by 0 days.

(21) Appl. No.: 10/866,480

(22) Filed: Jun. 12, 2004

(51) Int. Cl.[7] ..... A63B 21/068; A63B 5/00
(52) U.S. Cl. ..... 482/15; 434/257; 482/96
(58) Field of Search ..... 482/15–18, 51, 482/129, 64, 99, 90–92, 96; 434/247, 255; 473/229

(56) References Cited

U.S. PATENT DOCUMENTS 3,738,661 A * 6/1973 Moller ..... 473/229
4,017,070 A * 4/1977 Hilton ..... 482/18
4,778,174 A * 10/1988 Tolsma ..... 482/15
5,039,091 A * 8/1991 Johnson ..... 482/64
5,288,073 A * 2/1994 Noel ..... 473/229
5,419,747 A * 5/1995 Piaget et al. ..... 482/51
5,498,221 A * 3/1996 Blair, Jr. ..... 482/99
6,162,148 A * 12/2000 Lockwood et al. ..... 482/14
6,558,302 B2 * 5/2003 Cluff ..... 482/129

* cited by examiner

*Primary Examiner*—Stephen R. Crow
(74) *Attorney, Agent, or Firm*—Adam H. Jacobs

(57) ABSTRACT

A pole vault training device includes a pole replicating section having generally cylindrical forward and rearward pipe sections extending generally parallel and generally horizontally offset from each other and a training device mounting and support section including a pivot mount and a pivot shaft having an inner section rotatably mounted on the pivot mount and an outer end, the pivot shaft extending generally horizontally outwards from the pivot mount. An offset mount bar extends downwards and outwards from the outer end of the pivot shaft, and forward and rearward pipe section mount bars each extend upwards and forwards and upwards and rearwards respectively from adjacent the outer end of the offset mount bar to connect to and support the forward and rearward pipe sections.

15 Claims, 4 Drawing Sheets

POLE VAULT TRAINING DEVICE

BACKGROUND OF THE INVENTION

1. Technical Field

The present invention is directed to pole vault training devices and, more particularly, to a pole vault training device including a pole replicating section having generally cylindrical forward and rearward pipe sections extending generally parallel and generally horizontally offset from one another and a training device mounting and support section which includes a pivot mount, a pivot shaft extending outwards from the pivot mount which is axially rotatably mounted thereon, an offset mount bar extending downwards and outwards from the outer end of the pivot shaft and first and second pipe section mount bars which extend respectively upwards and forwards and upwards and rearwards from the offset mount bar to support the forward and rearward pipe sections such that a user of the pole vault training device may be suspended from the forward and rearward pipe sections and efficiently practice the swing up, close off, and launch segments of the pole vaulting process.

2. Description of the Prior Art

Of all of the various track and field events, few, if any, are more difficult to master than the pole vault. To even be qualified to become a pole vaulter, one must have the outstanding straight line speed of a sprinter combined with the upper body strength of a gymnast, and it is only then that one would begin to learn the intricacies of the pole vaulting technique. While there are at least a fair number of individuals who will qualify to participate in the pole vault based on sheer physical attributes, to become proficient at the pole vault it is necessary to master the intricacies of the technical aspects of pole vaulting, and this is a very difficult thing to do.

There are two major phases in the pole vault, the runway phase and the aerial phase. Mastery of the runway phase involves learning the proper technique of carrying the pole, the best ways to maximize the vaulter's speed on the runway, and the proper technique to plant the pole in the vault box. Although the practicing of these techniques in the runway phase can be physically demanding, the degree of danger encountered in practicing the runway phase is relatively small, as the vaulter never leaves the ground during practice. Also, mastery of the carrying and planting skills, although somewhat difficult, can be achieved by the majority of physically qualified persons with simple repetition of the runway phase. Mastery of the aerial phase, however, is far more difficult, due not only to the many steps which must be sequentially learned and translated into practice, but also due to the need to practice those steps in an aerial position which vastly increases the dangers encountered by the vaulter during the learning process. There is therefore a need for a training device which will allow vaulters the opportunity to practice the aerial phase of the pole vault.

Several different devices have been proposed in the prior art which attempt to provide devices for practicing the aerial phase of the pole vault. These include such devices as those found in Tolsma, U.S. Pat. No. 4,778,174 and Lockwood et al., U.S. Pat. No. 6,162,148. The Tolsma invention includes a pole which is gripped by the vaulter who is then swung into the air by a person pulling on a cable connected to the pole, thus allowing them to practice the aerial phase of the vault. The Tolsma invention has several disadvantages, however, in that it still requires the user to be elevated off of the ground surface a substantial distance, and furthermore control of this elevation is taken out of the vaulter's hands and placed in his or her assistant's hands, thus introducing another potential source for error. Also, because the vault pole of Tolsma is suspended from two cables, one at each end, operation of the Tolsma device is particularly susceptible to misuse due to poor positioning of the vaulter on the pole which cannot be corrected due to the flexible and generally non-rigid nature of the cables.

Likewise, Lockwood et al., is also designed primarily to practice the swing and stretch phase of the vault as was related in Tolsma, but uses a substantially different technique. Specifically, the device includes an upside down "U-shaped" tube member which fits over a horizontal gymnastic bar, a pair of extension members extending downwards from the top surface of the U-shaped member to handles which are offset from one another horizontally, and finally at least one strap is provided to secure the wrist of the user to prevent accidental release of the hand from the grip area. As with the Tolsma invention, Lockwood et al. includes several inherent disadvantages which do not permit the user of the Lockwood device to properly execute the intended function of the Lockwood device. Most importantly, because of the placement of horizontal bar 25, the vaulter cannot properly perform the close off and launch segments of the pole vault technique as would be done with a standard pole during the pole vault. Furthermore, because the Lockwood invention is intended to merely rest on a horizontal bar, the deficiencies in safety should be obvious to one skilled in the art, with the support bar positioned to fall off of the horizontal bar anytime the unit is rotated more than ninety degrees. Finally, Lockwood includes wrist straps which secure the wrist of a user to the unit which prevents the vaulter from releasing the Lockwood training unit should such release become necessary. There is therefore a need for a pole vault training device which will address and correct the deficiencies found in the prior art.

Therefore, an object of the present invention is to provide an improved pole vault training device.

Another object of the present invention is to provide a pole vault training device which includes a pole replicating section including generally cylindrical forward and rearward pipe sections extending generally parallel and generally horizontally offset from each other and a training device mounting and support section on which the pole replicating section is mounted.

Another object of the present invention is to provide a pole vault training device in which the training device mounting and support section includes a pivot mount, a pivot shaft axially rotatably mounted on the pivot mount, an offset mount bar extending downwards and outwards from the outer end of the pivot shaft and first and second pipe section mount bars, the first pipe section mount bar extending upwards and forwards from the offset mount bar and connected to and supporting the forward pipe section and the second pipe section mount bar extending upwards and rearwards from the offset mount bar and connected to and supporting the rearward pipe section.

Another object of the present invention is to provide a pole vault training device which will accurately replicate the aerial phase of the pole vault without requiring the vaulter to make repeated run-ups to the vault area and also will minimize the height to which the vaulter must go to replicate the aerial phase.

Another object of the present invention is to provide a pole vault training device in which the pivot bar is spring-loaded by a torsion spring or the like to replicate the pole's resistance to the vaulter's energy prior to the takeoff phase of the vault and to simulate the unloading of the pole's energy to launch the vaulter upwards.

Finally, an object of the present invention is to provide a pole vault training device which is relatively simple and efficient in construction and design and is safe and functional in use.

SUMMARY OF THE INVENTION

The present invention provides a pole vault training device including a pole replicating section having generally cylindrical forward and rearward pipe sections extending generally parallel and generally horizontally offset from each other and a training device mounting and support section including a pivot mount and a pivot shaft having an inner section rotatably mounted on the pivot mount and an outer end, the pivot shaft extending generally horizontally outwards from the pivot mount. An offset mount bar extends downwards and outwards from the outer end of the pivot shaft, the offset mount bar including an inner end connected to the outer end of the pivot shaft and an outer end. Finally, the present invention includes forward and rearward pipe section mount bars, the forward pipe section mount bar extending upwards and forwards from adjacent the outer end of the offset mount bar and connected to and supporting the forward pipe section, the rearward pipe section mount bar extending upwards and rearwards from the offset mount bar and connected to and supporting the rearward pipe section.

As thus described, the pole vault training device of the present invention provides several advantages over those devices found in the prior art. For example, because the pole vault training device is securely mounted on the support structure, there is little if any chance of the training device being dislodged from the support structure while a vaulter is using the device, a problem which is found in the prior art. Furthermore, because the offset mount bar does not extend past the position of the rearward pipe section, the vaulter using the present invention may fully "close off" and launch to properly execute the aerial phase of the vault technique. Also, the relatively simple design of the present invention will mean that the invention is both affordable and produceable, thus permitting its use by all levels of vaulters from beginner to expert. Finally, it should be noted that the design of the pole vault training device of the present invention permits the vaulter to accurately replicate each and every step of the aerial phase of the pole vault technique, a claim which certainly cannot be made by those devices found in the prior art. The present invention thus provides a substantial improvement over those devices found in the prior art.

DESCRIPTION OF THE PREFERRED EMBODIMENT

Figure 1:
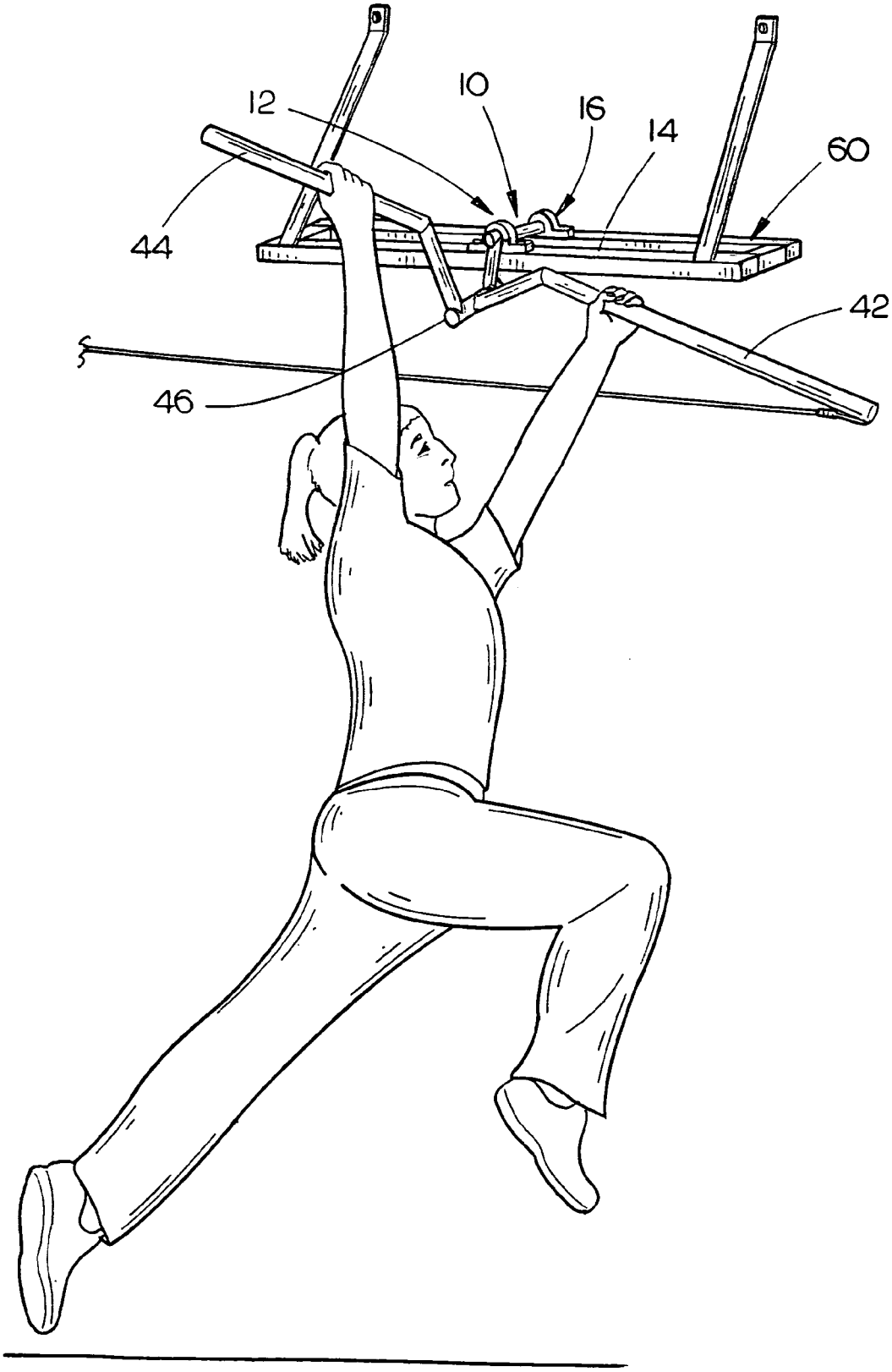
FIG. 1 is a perspective view of the pole vault training device of the present invention in use.

The pole vault training device 10 of the present invention is shown best in FIGS. 1–5 as including a training device mounting and support section 12 and a pole replicating section 40 mounted on and connected to the training device mounting and support section 12. In the preferred embodiment, the training device mounting and support section would include a mounting beam 14 which extends generally horizontally outwards from a wall or other support structure 60 and is securely connected thereto to provide a stable and safe mounting location for the pole vault training device 10 of the present invention. Mounted on mounting beam 14 is a pivot mount 16 which, in the preferred embodiment, would include inner and outer rotating pivot mount support collars 18*a* and 18*b* which are mounted on mounting beam 14 in coaxial alignment, as shown best in FIGS. 1 and 2. Rotatably mounted within pivot mount support collars 18*a* and 18*b* is a pivot shaft 20 which extends generally parallel with mounting beam 14 and extends generally horizontally therefrom, as shown best in FIGS. 2 and 3. In the preferred embodiment, the pivot shaft 20 would be a metal rod which is generally cylindrical in shape and which is mounted within pivot mount support collars 18*a* and 18*b* such that the pivot shaft 20 is rotatable about its center longitudinal access. The pivot shaft 20 would preferably extend beyond the outer end of mounting beam 14 approximately 3 to 12 inches in order to permit proper operation of the pole vault training device 10, although it should be noted that the length of pivot shaft 20 may be modified or changed according to the design of pivot mount 16 and the desired extension of pivot shaft 20 beyond mounting beam 14, so long as the pivot shaft 20 is rotatably secured within pivot mount 16.

Figure 2:
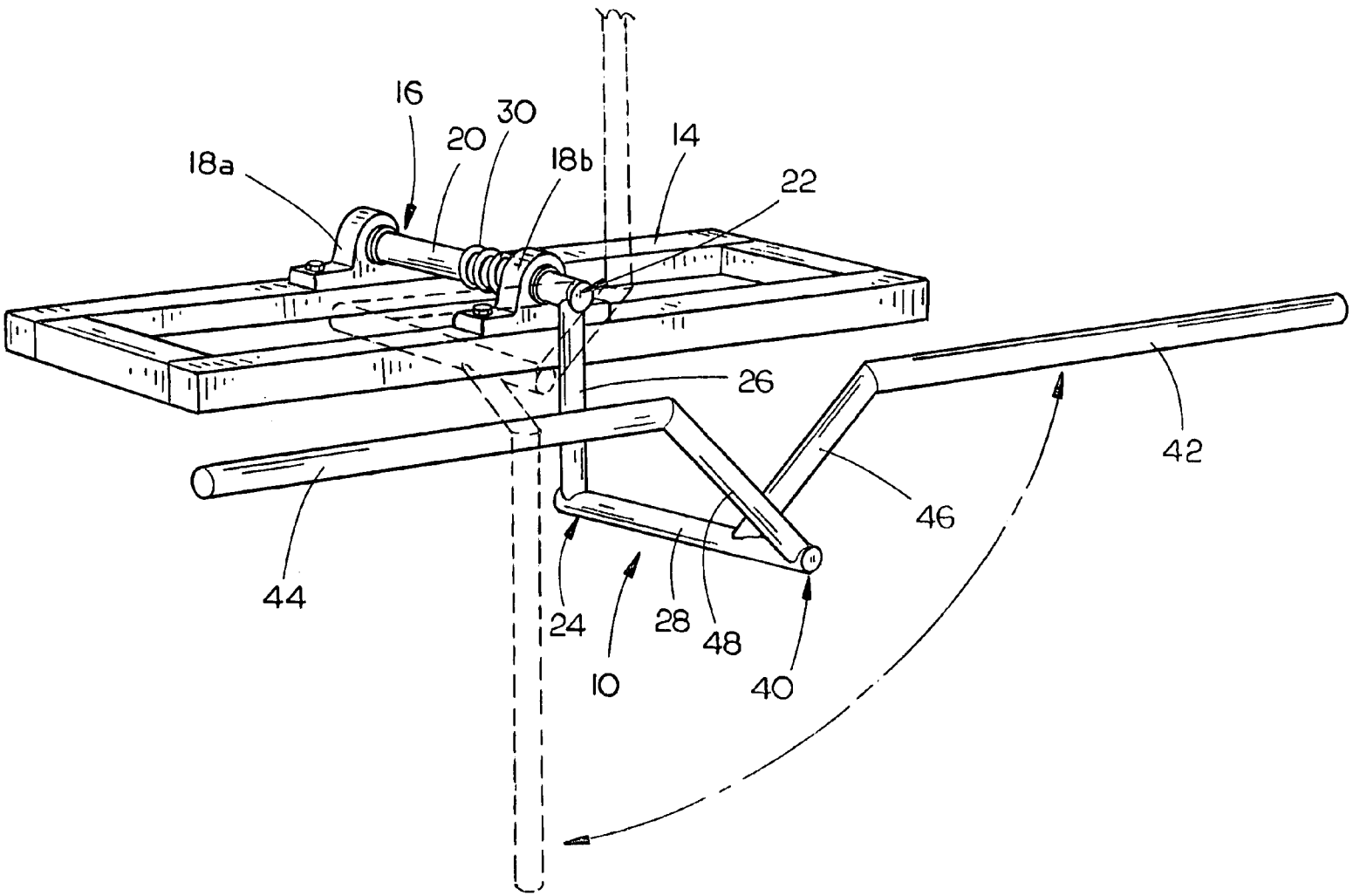
FIG. 2 is a perspective view of the pole vault training device of the present invention showing the pivot motion of the device.
Figure 4:
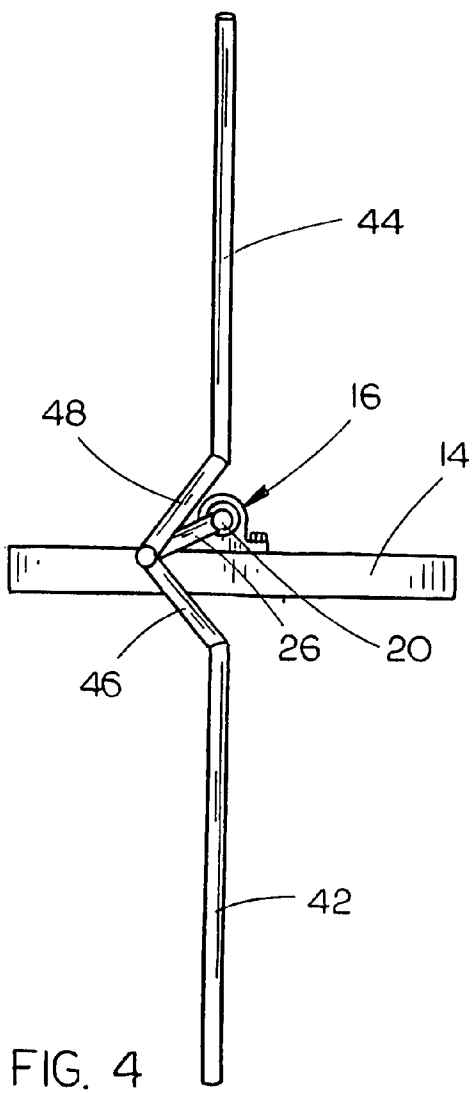
FIG. 4 is a side elevational view of the pole vault training device of the present invention.
Figure 3:
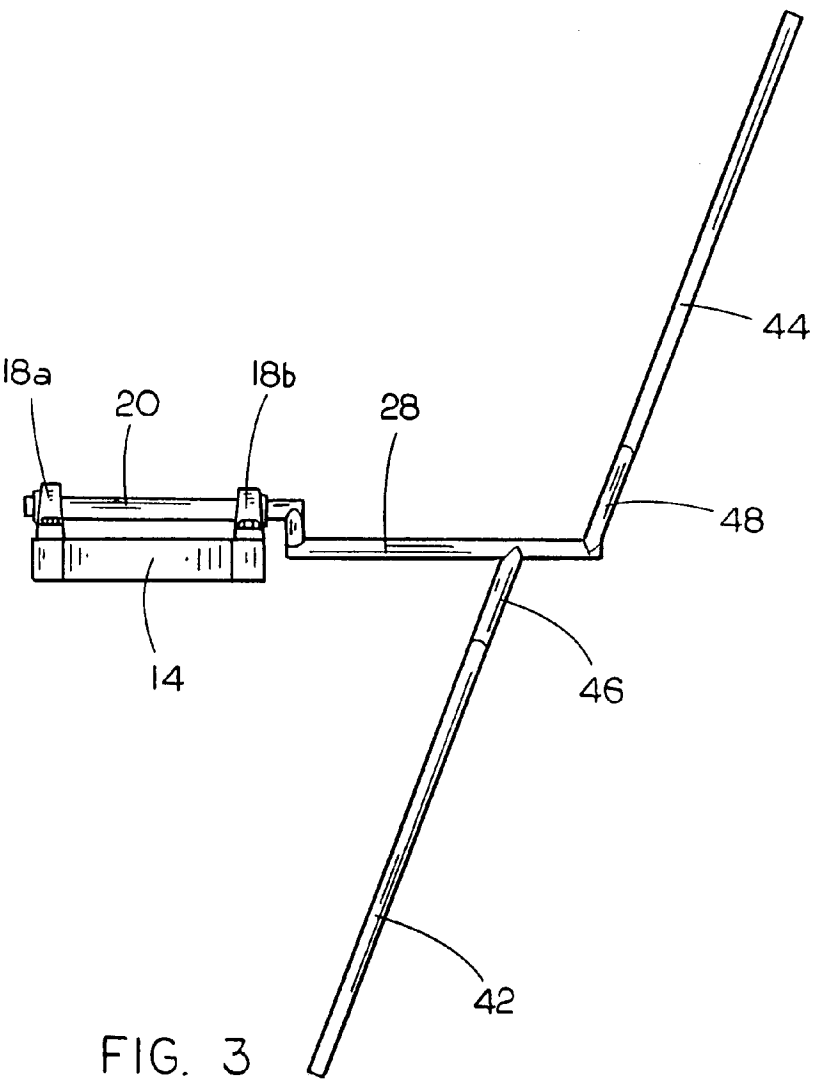
FIG. 3 is a rear elevational view of the pole vault training device of the present invention.
Figure 5:
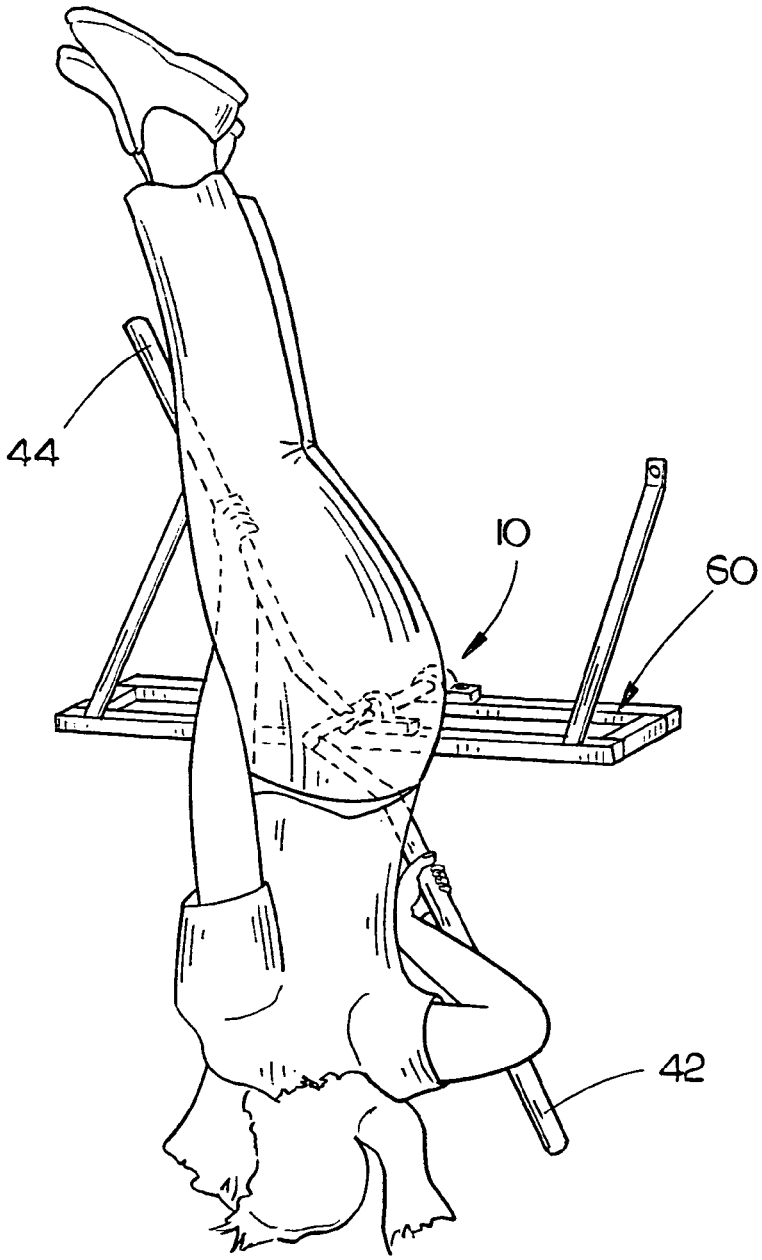
FIG. 5 is a side elevational view of the pole vault training device of the present invention in the vertical position.

Mounted on the outer end 22 of pivot shaft 20 is an offset mount structure 24 which, in the preferred embodiment, includes a downwardly depending vertical offset mount bar 26 and an outwardly extending horizontal offset mount bar 28, vertical offset mount bar 26 and horizontal offset mount bar 28 forming the general L-shape of offset mount structure 24, as shown best in FIGS. 2 and 3. In the preferred embodiment, vertical offset mount bar 26 and horizontal offset mount bar 28 would each be constructed of a metal bar similar to that used in connection with pivot shaft 20 with the connections between the pivot shaft 20, vertical offset mount bar 26 and horizontal offset mount bar 28 being made via welding, bolt and nut connections or any other appropriate fastening and connecting method which will safely and securely interconnect the pivot shaft 20, vertical offset mount bar 26 and horizontal offset mount bar 28. Furthermore, in the preferred embodiment, it is preferred that vertical offset mount bar 26 have a length of approximately 6 to 12 inches and that horizontal offset mount bar 28 have a length of approximately 12 to 24 inches, with these dimensions determined in general by the desired pivot characteristics of the pole vault training device 10 of the present invention. One of the important functional features of offset mount structure 24, however, is that it permits the outer end of horizontal offset mount bar 28 to rotate in a circle of larger diameter than the diameter of pivot shaft 20, and this larger rotational characteristic of the offset mount structure 24 is important for proper replication of the pole vault process when the pole vault training device 10 of the present invention is in use. Of course, it may be possible to substitute different arrangements of bar and mounting structures which would perform a similar function to that described in connection with offset mount structure 24, such as replacing vertical and horizontal offset mount bars 26 and 28 with a single diagonally-extending mount bar or a single bar which has at least one bend in the mount bar, the substitution of which would be understood by one skilled in the art of metal fabrication and construction.

The pole replicating section 40 of the pole vault training device 10 of the present invention is shown best in FIGS. 1–3 as being mounted adjacent the outer end of horizontal offset mount bar 28 and includes generally cylindrical forward and rearward pipe sections 42 and 44 which are connected to the horizontal offset mount bar 28 by forward and rearward pipe section mount bars 46 and 48 which extend between and connect the forward and rearward pipe sections 42 and 44 to the horizontal offset mount bar 28. As shown best in FIGS. 3 and 4, forward pipe section mount bar 46 would extend upwards and forwards from adjacent the outer end of horizontal offset mount bar 28 at an angle of approximately 45 degrees, which the length of forward pipe section mount bar 46 being approximately 6 to 10 inches. Rearward pipe section mount bar 48 extends rearwards and upwards from the horizontal offset mount bar 28 at the outer end of horizontal offset mount bar 28 outwards of the connection of forward pipe section mount bar 46 to horizontal offset mount bar 28 such that the forward pipe section 42 and rearward pipe section 44, although supported at approximately the same height, are horizontally offset from one another approximately 2 to 4 inches. This offset is important for replication of the actual pole used in the pole vault because as a pole vaulter using an actual pole makes his or her vault, the pole does not bend directly forward towards the bar over which the pole vaulter is attempting to vault, but instead bends outwards and forwards to the forward side of the vaulter to remove the pole from the vaulter's upward path and thus permit the vaulter to reach maximum extension of the pole. The horizontal offset between forward pipe section 42 and rearward pipe section 44 replicates this pole offset during the aerial phase of the pole vault far more accurately than would a single unitary pole replicating bar. The additional reason for the horizontal offset between forward and rearward pipe sections 42 and 44 would be explained further later in this disclosure.

It is preferred that the connections between forward pipe section 42, forward pipe section mount bar 46 and horizontal offset mount bar 28 be done in the same manner as preformed in connection with the connections between pivot shaft 20, vertical offset mount bar 26 and horizontal offset mount bar 28, and the same connections would be also applied to rearward pipe section 44 and rearward pipe section mount bar 48. It is further expected that it may be advantageous to wrap forward and rearward pipe sections 42 and 44 with a fiberglass wrap material to provide even better replication of the feel of the pole for the pole vaulter, although such modification is not critical to the present invention. Finally, an important element of the present invention is that the forward pipe section 42 and rearward pipe section 44 are angled relative to pivot shaft 20, specifically in that instead of projecting generally perpendicularly to the pivot shaft, the forward pipe section 42 and rearward pipe section 44 are angled from perpendicular with the outer end of forward pipe section 42 closer to pivot shaft 20 than the outer end of rearward pipe section 44 such that pivot shaft 20 and forward pipe section 42 form an angle of approximately 70° to 85°. This angle has been found to best simulate the actual angle of the pole during vaulting, and thus provides increased accuracy for practice of pole vaulting technique.

In the preferred embodiment, pivot mount 16 would further include a torsion spring 30 which will replicate the pole's resistence to the vaulter's energy prior to the take off phase of the vault. The spring will also allow the vaulter the feel the energy transfer as if the pole were being moved forward and bent. In operation, torsion spring 30 would bias pivot shaft 20 in a counter-clockwise direction (for right-handed vaulters) such that as the vaulter moves the pole replicating section 40 from horizontal to vertical, the upward thrust of the pole is replicated by the tensioning of torsion spring 30. Of course, the inclusion of torsion spring 30 is not critical to the present invention but it is believed that the inclusion of torsion spring 30 will increase the realism and therefore the training effectiveness of the pole vault training device 10 of the present invention. Substitution of other tensioning devices for the torsion spring 30 should also be understood to be a part of this disclosure, and such substitution would be understood by one skilled in the art.

Additional features that are expected to be included in the pole vault training device 10 of the present invention which are not strictly necessary for functioning of the pole vault training device 10 include a one-way lock (not shown) which will be mounted on the pivot mount 16 and pivot shaft 20 which will operate to lock the forward and rearward pipe sections 42 and 44 into a vertical position after the vaulter has swung the forward and rearward pipe sections 42 and 44 into that vertical position in order to replicate the vertical positioning of the actual pole vault pole following the pole's release of its energy. This one-way lock may prove effective in permitting the vaulter to gain confidence and focus on particular elements of the pole vault procedure which ordinarily could not be practiced for other than a brief period of time. Also, it is expected that the vertical support structure 60, be it a wall, tubing, or the like, on which the mounting beam 14 is mounted could further include a compression spring device (not shown) which will simulate the pole's active compression downward as it is being jumped on by the vaulter and its reactive release upwards as the vaulter "swings through" during the pole vault process. It is has been found that only a relatively small amount of movement upwards by the pole vault training device 10 of the present invention will successfully simulate the actual feel of the upward movement of the pole vault pole and thus the compression spring will generally accurately simulate the upward motion of the pole during the pole vault. Of course, many other types of vertical extension devices such as hydraulic rams, pneumatic rams, or winch-type devices may be substituted for the compression spring of the present invention so long as the intended function of moving the pole vault training device 10 upwards to simulate the upward movement of the pole is achieved.

Finally, the pole vault training device 10 of the present invention further contemplates use of a horizontal tracking device mounted at the base of the main vertical support structure 60 which is designed to simulate the horizontal movement of the pivot point of the pole during the swing up and close off phases of the vault. Many different devices may be used to move the main vertical support structure 60 in a horizontal movement, and in many instances it may be only necessary to move the pivot mount 16 alone in a horizontal direction to achieve the same purposes of simulating the horizontal movement of the pivot point of the vault. Each of these additions to the pole vault training device 10 of the present invention should be noted as not being fully necessary to achieve the purposes of the pole vault training device 10 but have been found to add to the accuracy of the simulation of the pole vault process and thus their inclusion as elements of the present invention is desirable.

A vaulter using the pole vault training device 10 of the present invention would use the device in the following manner. It is preferred that the mounting beam 14 be positioned approximately 6 to 10 feet above the floor surface over which the pole vault training device 10 of the present invention is mounted. This will require the pole vaulter to grasp the forward and rearward pipe sections 42 and 44 as if the forward and rearward pipe sections were an actual pole vault pole yet at the same time he or she will be suspended from the forward and rearward pipe sections 42 and 44 with their feet off the ground in order to prevent improper use of the pole vault training device 10 of the present invention. Once the vaulter is positioned on the pole replicating section 40 as shown best in FIG. 1, he or she will then separate their drive knee leg from their trail leg and dorsal flex the foot of the drive knee leg to create a 90 degree angle. The separation of the top and bottom hands of the vaulter will then simulate a perfect plant triangle of approximately 45° and the vaulter's body will assume an inverted C-position prior to the trail leg swing portion of the vault to maximize the stretch reflex necessary for a powerful swing through of the trail leg. The vaulter's trail leg is then swept through quickly and powerfully to initiate the vertical phase of the vault. The energy from the completed trail leg kick then is transferred to the beginning of the "rowing motion" which is used to bring the vaulter's body vertical with his or her feet positioned directly above his or her head. It is precisely at this point that the critical nature of the horizontal offset of forward and rearward pipe sections 42 and 44 and particularly forward pipe section mount bar 46 and rearward pipe section mount bar 48 can best be seen as without this horizontal offset, the vaulter will not be able to properly swing his or her hips upwards through the offset gap 50 and move from the swing out phase to the vertical phase of the vault. Without this offset gap 50, the vaulter will not be able to properly practice the vertical phase of the vault and the pole vault training device 10 of the present invention will have its operative capabilities severely diminished.

Continuing with the vaulting procedure, at this point with the vaulter's body generally vertical, if there is a compression spring or the like present in the main vertical support structure 60, it will be activated to simulate correct transferring of the poles energy into the upward swing of the athlete. The vaulter would then flex in his or her bottom arm to allow the body to remain close to the pole during the close off phase of the pole vault and finally the compression spring and torsion spring 30 would be released to replicate the release of the stored energy of the pole at the launch phase of the vault.

The use of the pole vault training device 10 is thus seen to be a substantial improvement over the prior art. A vaulter may repeat the swing up and close off phases of the vault as many times as his or her wishes to without using valuable reserves of energy which would be lost in practicing the run up phase of the vault as it was required by prior practice techniques. Furthermore, because of the offset gap 50 in pole replicating section 40, the vaulter may properly practice the close off and launch phases of the vault, particularly the swinging of his or her hips through the offset gap 50, which is very important for proper technique. Finally, because of the offset mount structure 24 and vertical positioning of forward and rearward pipe sections 42 and 44, the swing characteristics of the vault are very closely approximated which is invaluable for purposes of replicating the physical characteristics of the pole vault.

It is to be understood that numerous additions, modifications and substitutions may be made to the pole vault training device 10 of the present invention which fall within the intended broad scope of the appended claims. For example, the specific size, shape and construction materials used in connection with the present invention may be modified or changed so long as the performance and functional characteristics of the present invention are maintained. Furthermore, the precise offset angles of the elements of the present invention are not specifically critical to the performance characteristics of the present invention, so long as the presence of offset gap 50 and the rotating mount of pivot shaft 20 is maintained. Finally, the inclusion of the various optional elements of the present invention is not critical to the functionality of the present invention, however it has been found that each of those additional inventive elements add to the accuracy of the simulation and therefore their inclusion is desirable.

There has therefore been shown and described a pole vault training device 10 which accomplishes at least all of its intended objectives.

We claim:

1. A pole vault training device comprising:

a pole replicating section including generally cylindrical forward and rearward pipe sections extending generally parallel and generally horizontally offset from each other;

a training device mounting and support section including;

a pivot mount adapted for mounting on a support structure;

a pivot shaft having an inner section rotatably mounted on said pivot mount and an outer end, said pivot shaft extending generally horizontally outwards from said pivot mount;

offset mount means extending downwards and outwards from said outer end of said pivot shaft, said offset mount means including an inner end connected to said outer end of said pivot shaft and an outer end; and forward and rearward pipe section mount means, said forward pipe section mount means extending upwards and forwards from said offset mount means and connected to and supporting said forward pipe section, said rearward pipe section mount means extending upwards and rearwards from said offset mount means and connected to and supporting said rearward pipe section.

2. The pole vault training device of claim 1 wherein said forward pipe section mount means is mounted on said offset mount means inwards of said rearward pipe section mount means thereby forming an offset gap between said forward pipe section mount means and said offset mount means whereby the vaulter can swing their inner hip into and through said offset gap, thus practicing proper vaulting technique.

3. The pole vault training device of claim 1 wherein said pivot mount comprises inner and outer rotating pivot mount support collars mounted in coaxial alignment for rotatably supporting said pivot shaft therein.

4. The pole vault training device of claim 1 wherein said forward and rearward pipe sections are angled from perpendicular with the outer end of said forward pipe section positioned inwards closer to said pivot shaft than the outer end of said rearward pipe section such that said pivot shaft and said forward pipe section form an angle of approximately 70° to 85°.

5. The pole vault training device of claim 1 wherein said pivot mount further comprises biasing means operative to bias said pivot shaft in a counter-clockwise direction for right-handed vaulters and in a clockwise direction for left-handed vaulters whereby as the vaulter rotates said pole replicating section from generally horizontal to generally vertical, tensioning of said biasing means generally replicates the upward thrust of a pole vault pole.

6. The pole vault training device of claim 1 wherein said biasing means comprises a torsion spring mounted on said pivot mount and operatively connected to said pivot shaft for biasing said pivot shaft thereby applying a rotational force to said pivot shaft to generally replicates the upward thrust of a pole vault pole.

7. The pole vault training device of claim 1 wherein said offset mount means comprises a downwardly depending vertical offset mount bar mounted on said outer end of said pivot shaft and a horizontal offset mount bar mounted on a lower end of said vertical offset mount bar and extending outwards therefrom such that said vertical offset mount bar and said horizontal offset mount bar forming a general L-shape.

8. The pole vault training device of claim 1 wherein said forward and rearward pipe section mount means each comprise metal bars each extending upwards at angles of approximately 30° to 60° from horizontal.

9. A pole vault training device comprising:

a pole replicating section including generally cylindrical forward and rearward pipe sections extending generally parallel and generally horizontally offset from each other;

a training device mounting and support section including;

a pivot mount adapted for mounting on a support structure;

a pivot shaft having an inner section rotatably mounted on said pivot mount and an outer end, said pivot shaft extending generally horizontally outwards from said pivot mount;

a downwardly depending generally vertical offset mount bar mounted on said outer end of said pivot shaft and a generally horizontal offset mount bar mounted on a lower end of said generally vertical offset mount bar and extending outwards therefrom to an outer end such that said generally vertical offset mount bar and said generally horizontal offset mount bar form a general L-shape; and forward and rearward pipe section mount means, said forward pipe section mount means mounted on and extending upwards and forwards from said generally horizontal offset mount bar and connected to and supporting said forward pipe section, said rearward pipe section mount means mounted on and extending upwards and rearwards from said generally horizontal offset mount bar and connected to and supporting said rearward pipe section, said forward pipe section mount means mounted on said offset mount section inwards of said rearward pipe mount section thereby forming an offset gap between said forward pipe section mount means and said offset mount section whereby the vaulter can swing their inner hip into and through said offset gap, thus practicing proper vaulting technique.

10. The pole vault training device of claim 9 wherein said pivot mount comprises inner and outer rotating pivot mount support collars mounted in coaxial alignment for rotatably supporting said pivot shaft therein.

11. The pole vault training device of claim 9 wherein said forward and rearward pipe sections are angled from perpendicular with the outer end of said forward pipe section positioned inwards closer to said pivot shaft than the outer end of said rearward pipe section such that said pivot shaft and said forward pipe section form an angle of approximately 70° to 85°.

12. The pole vault training device of claim 9 wherein said pivot mount further comprises biasing means operative to bias said pivot shaft in a counter-clockwise direction for right-handed vaulters and in a clockwise direction for left-handed vaulters whereby as the vaulter rotates said pole replicating section from generally horizontal to generally vertical, tensioning of said biasing means generally replicates the upward thrust of a pole vault pole.

13. The pole vault training device of claim 9 wherein said biasing means comprises a torsion spring mounted on said pivot mount and operatively connected to said pivot shaft for biasing said pivot shaft thereby applying a rotational force to said pivot shaft to generally replicates the upward thrust of a pole vault pole.

14. The pole vault training device of claim 9 wherein said offset mount means comprises a downwardly depending vertical offset mount bar mounted on said outer end of said pivot shaft and a horizontal offset mount bar mounted on a lower end of said vertical offset mount bar and extending outwards therefrom such that said vertical offset mount bar and said horizontal offset mount bar forming a general L-shape.

15. The pole vault training device of claim 9 wherein said forward and rearward pipe section mount means each comprise metal bars each extending upwards at angles of approximately 30° to 60° from horizontal.

* * * * *